United States Patent [19]

Sullivan

[11] 4,033,298

[45] July 5, 1977

[54] BOTTOM SUPPORTED, HOPPER BOTTOM FURNACE FOR PULVERIZED COAL FIRING

[75] Inventor: Robert Patton Sullivan, Chattanooga, Tenn.

[73] Assignee: Combustion Engineering, Inc., Windsor, Conn.

[22] Filed: June 23, 1976

[21] Appl. No.: 699,107

[52] U.S. Cl. ..... 122/510; 122/235 N

[51] Int. Cl.[2] ..... F22B 37/24

[58] Field of Search ..... 122/235 R, 235 N, 332, 122/333, 336, 473, 478, 510

[56] References Cited

UNITED STATES PATENTS

| | | | |
|---|---|---|---|
| 2,299,559 | 10/1942 | Rehm | 122/235 |
| 2,526,416 | 10/1950 | Rehm | 122/235 |
| 2,583,599 | 1/1952 | Schoegsow | 122/510 |
| 2,870,750 | 1/1959 | Langvand | 122/510 |
| 2,979,041 | 4/1961 | Young | 122/510 |

*Primary Examiner*—Kenneth W. Sprague
*Attorney, Agent, or Firm*—Robert L. Olson

[57] ABSTRACT

A steam generator having a coal fired furnace including water cooled walls, and having a hopper bottom. A plurality of steel struts are provided which extend between the furnace walls at a level at or above the top of the hopper bottom, and the furnace inlet ring header located at the bottom of the hopper, so that the unit can be bottom supported. The steam generating tubes extending upwardly out of the ring header and forming the furnace walls each contain a bend therein, so as to be flexible enough to accommodate differential thermal growth of the struts relative to the adjacent furnace walls during transient temperature occurrences.

3 Claims, 4 Drawing Figures

BOTTOM SUPPORTED, HOPPER BOTTOM FURNACE FOR PULVERIZED COAL FIRING

BACKGROUND OF THE INVENTION

Because of thermal expansion problems, most large sized steam generators are supported from the top, being hung from a rigid girder assembly. The structurally large girder assembly necessary for supporting a steam generator is quite expensive, and also requires relatively high head room, making access difficult to some parts of the assembly. Thus, some recently constructed steam generators have been built which are supported from the bottom. These have all been oil or gas fired units, where it is possible to have each of the tube-lined walls of the furnace extending upwardly in a single plate, so as to form a part of the load supporting structure. In a coal fired unit, it is necessary to have a hopper bottom, through which the coal ash and/or slag can be discharged during operation of the unit without too much loss of heat by radiation through the bottom opening.

SUMMARY OF THE INVENTION

The steam generator of the invention has a coal fired furnace including water cooled walls, and a hopper bottom for permitting discharge of the coal ash and slag. A plurality of steel struts are provided which extend between the furnace walls at a level at or above the top of the hopper bottom, and the furnace inlet ring header located at the bottom of the hopper, so that unit can be bottom supported. The steam generating tubes extending upwardly out of the ring header and lining the furnace walls each contain a bend therein, so as to be flexible enough to accommodate differential thermal growth of the struts relative to the adjacent furnace walls during transient temperature occurrences. The drums are independently supported outside of the furnace by the downcomers which supply the ring header with water.

DESCRIPTION OF THE PREFERRED EMBODIMENT

Figure 1:
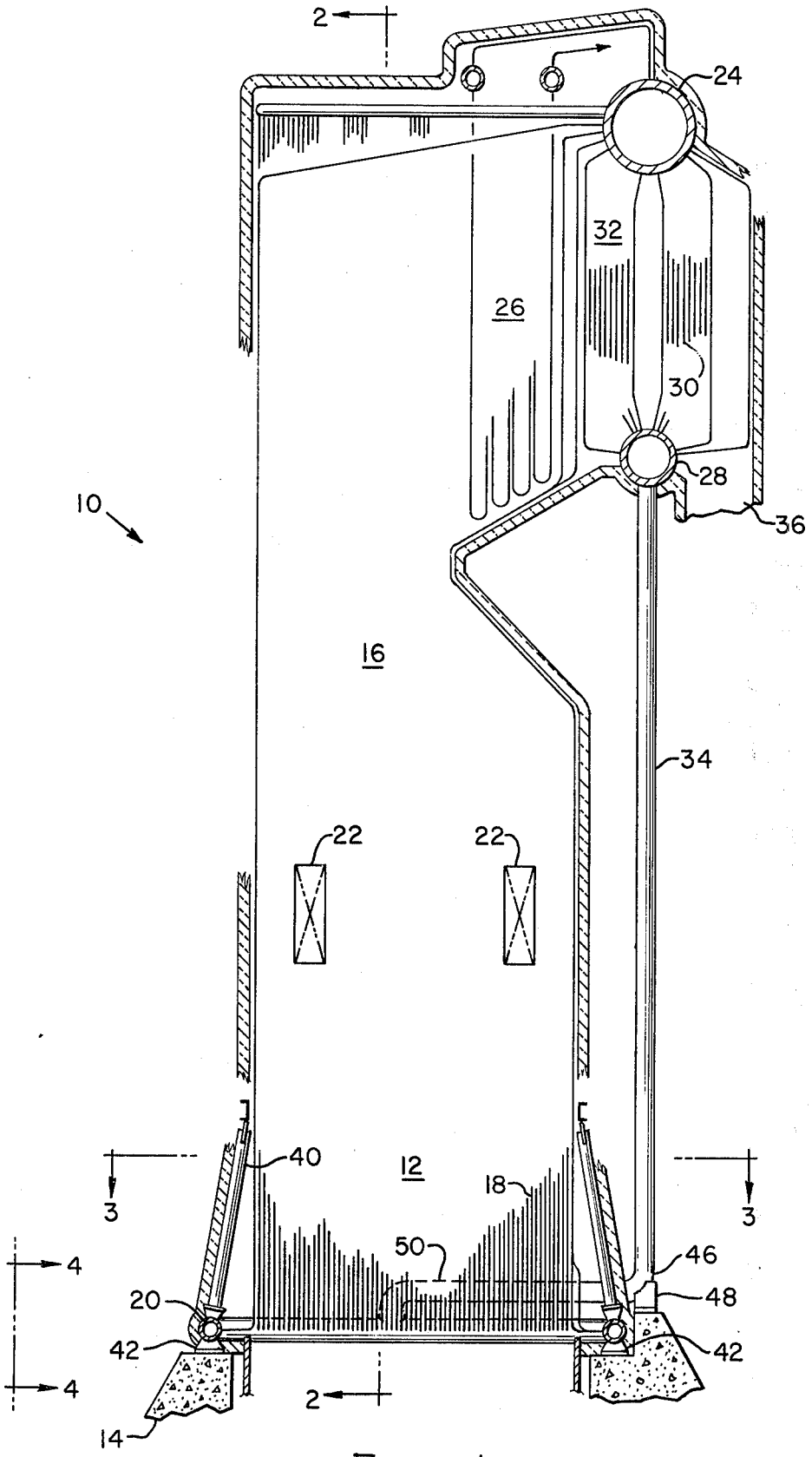
FIG. 1 is a diagrammatic sectional side elevation of a steam generator constructed in accordance with the invention.

Looking now to FIG. 1, a coal fired steam generator 10 having a hopper bottom 12 therein, is shown. The steam generator is bottom supported on foundation 14, which completely encircles the unit at its bottom. All four walls of the furnace 16 are lined with steam generating tubes 18, which are welded together, and are supplied with water by the inlet ring header 20, located at the bottom of the hopper. The furnace 16 is supplied with pulverized coal and air through burners 22. The water flowing through tubes 18 absorbs heat, with a mixture of water and steam being discharged into upper drum 24.

Figure 2:
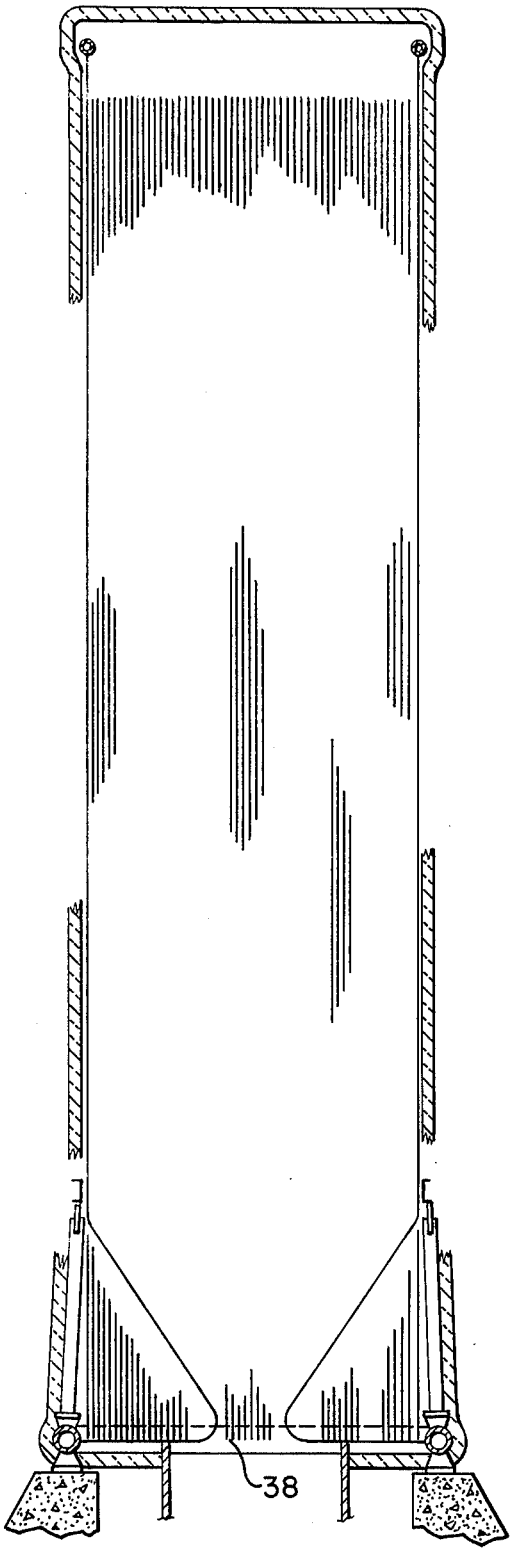
FIG. 2 is a view taken along line 2—2 of FIG. 1.

The steam is separated in drum 24, thereafter flows through superheater 26, before being discharged to its ultimate point of use. Steam is also generated in the boiler tubes extending between upper drum 24 and the lower drum 28. The water flows through downcomer tubes 30 into the lower drum 28, and upwardly through riser tubes 32, by means of natural circulation. Water is also supplied to the inlet ring header 20 from lower drum 28 by means of a pair of downcomers 34. The combustion gas after giving up a majority of its heat, is discharged from the unit through rear pass 36. Coal ash or slag is allowed to escape from the furnace 16 through opening 38 (FIG. 2) in the bottom of the hopper 12. The ash and slag fall into an ash pit (not shown) beneath the unit, from where it can be disposed of.

Figure 3:
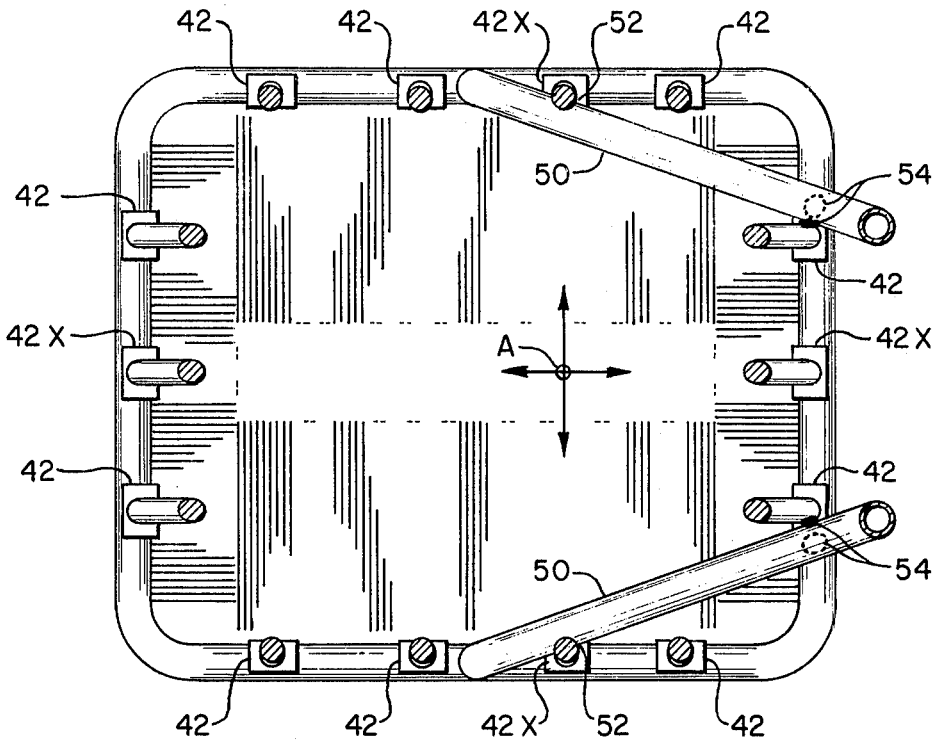
FIG. 3 is a view taken along line 3—3 of FIG. 1.
Figure 4:
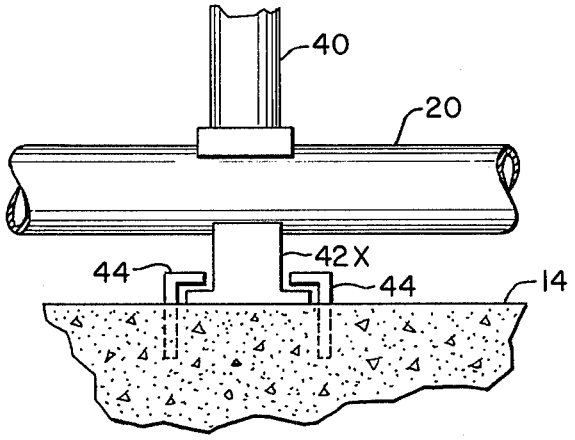
FIG. 4 is an enlarged view of one of the members used to secure the steam generator to its foundation.

The manner in which the unit is supported from the bottom will now be described. A plurality of steel struts 40 are welded or otherwise adequately secured to the tubes 18 forming the furnace walls at a level at or above the hopper bottom 12. These struts are welded at their lower ends to the inlet ring header 20. As shown in FIG. 3, fourteen struts 40 are shown, but there may be more or less depending on the size of the unit. Located beneath the header 20 directly under each of the fourteen strut locations are pedestals 42. When the boiler is initially started up, the ring header 20 will go from atmospheric temperature up to 400°–500° F, resulting in growth of the header of one inch or more along each side. In order to permit this growth, the ring header 20 is only secured at one point on each of its sides to the foundation 14 by means of one of the pedestals 42X (FIG. 3), and each of these are secured by means of a slip fit, which permits movement in one direction, but not in the other direction. As shown in FIG. 4, a pair of angle irons 44 are embedded in the foundation 14, and include a flat bar portion closely overlying the base of pedestal 42X. These angle irons 44 will permit movement in one direction, but will not permit movement to the left or right, as shown in FIG. 4. All four of the anchored pedestals 42X are so mounted to permit the header to grow inwardly or outwardly, but do not permit sidewise movement. Thus, as seen in FIG. 3, there is a zero point of expansion A, which is the intersection of the lines passing through the four anchored pedestals 42X. All of the other pedestals 42 are free to slide on the upper surface of the foundation 14, and if necessary, these pedestals can be provided with an anti-friction bearing plate.

The downcomers 34 are located directly beneath the drums 24 and 36, and extend vertically downward to provide the structural column support therefore. At the furnace bottom a bend 46 in each downcomer rests in an anti-friction bearing plate cradle 48, which is anchored to the foundation 14. The horizontal run 50 of each downcomer is welded at points 52 and 54 to ring header 20, as seen in FIG. 3 to give rigidity thereto. Thus, as the ring header expands and contracts, the curved portion 46 of each downcomer is free to slide in the curved cradle 48, while still acting as a fixed end column for supporting the drums 24 and 36 and their associated tubes.

The struts 40 are located inside the insulating material 50 which completely encases the steam generator, so they are at a temperature close to that of the furnace walls 18 during normal operation. Since these struts 40 are not exposed to radient heat from the furnace, they will be somewhat cooler than the tubes 18, for example 100° F cooler, and thus they can be of solid cross-section, with no water cooling thereof being necessary.

Because the portion of the tubes 18 forming the hopper bottom 12 will be hotter than the struts 40, their thermal growths will be greater than that of struts 40.

Thus, the tubes 18 on all four walls of the hopper bottom 12 must be flexible enough to accommodate this differential expansion. This is accomplished by providing each of the tubes 18 with a bend therein. The tubes 18 lining the left and right walls of the hopper bottom naturally contain bends, so as to form the tapered hopper walls. The other two walls have a horizontal run extending out of the ring header 20, before bending, and extending in a straight vertical direction, as best shown in FIG. 3. The struts along these walls extend at a slight angle to the vertical, in order to permit the adjacent tubes to be free of bends above the ring header level. Otherwise, some of the hopper bottom tubes would have to contain three dimensional bends therein, which complicate the fabrication thereof. The front and rear wall tubes are welded along the seam where they lie adjacent the other two walls, so as to form a gas tight, welded wall construction.

From the above, it can be seen that the drums are independently supported by the downcomers. The tubular walls 18 above the struts are supported by the struts, and are free to thermally expand in an upper direction in an unrestricted manner. The portion of the tubes 18 adjacent the struts all have bends therein, to provide these portions of the tubes with sufficient flexibility to permit more thermal growth than the adjacent struts. The tubes 18 near the upper portion of the furnace inherently have bends therein, in forming the top of the furnace which will allow the furnace to thermally grow at a different rate than the drum and downcomer arrangement, without causing thermal stress problems.

What is claimed is:

1. A bottom supported steam generator including a furnace means for supplying coal and air to the furnace, water cooled tubes lining all four walls of the furnace, said tubes being welded together so as to form a gas tight structure, a hopper bottom for the furnace, inlet header means below and encircling the hopper bottom, the tubes lining all four walls of the hopper bottom and the rest of the furnace being connected to and supplied with water from the inlet header means, a plurality of structural metal struts extending between the inlet header means and each of the four furnace walls at a level above the hopper bottom, each of the tubes lining the hopper bottom walls containing a bend therein adjacent the struts so as to be flexible enough to prevent excessive thermal and excessive mechanical stresses therein, and each of the tubes lining all four walls of the furnace above the level of the strut connections extending in a straight vertical line.

2. The bottom supported steam generator set forth in claim 1, including a flue for the conduction of gases from the furnace located vertically parallel and adjacent to the furnace, a drum arrangement located in the upper portion of the flue, a pair of downcomers extending directly beneath the drum arrangement and acting as the support means for the drum arrangement.

3. The bottom supported steam generator set forth in claim 2, wherein the downcomers extend vertically downward to a point adjacent the hopper bottom, and then bend to extend horizontally to the inlet header means for supplying water thereto, and cradle support means beneath the bends for slidably supporting the vertical runs of the downcomers.

* * * * *